United States Patent [19]

d'Orgelys

[11] 4,188,688

[45] Feb. 19, 1980

[54] FASTENER

[76] Inventor: Henri Y. d'Orgelys, 3936 San Clerc Rd., Jacksonville, Fla. 32217

[21] Appl. No.: 881,642

[22] Filed: Feb. 24, 1978

[51] Int. Cl.[2] ..... A44B 17/00; A44B 9/18

[52] U.S. Cl. ..... 24/211 P; 24/221 R; 24/157

[58] Field of Search ..... 24/157, 160, 230 TC, 24/211 P, 221 R, 221 RC

[56] References Cited

U.S. PATENT DOCUMENTS

| | | | |
|---|---|---|---|
| 708,610 | 9/1902 | Zelly | 24/157 R |
| 1,042,291 | 10/1912 | Takahashi | 24/157 R |
| 1,590,781 | 6/1926 | Tate | 24/221 R |
| 2,513,553 | 7/1950 | Dzus | 24/221 R |
| 2,564,101 | 8/1951 | Dzus | 24/221 R |
| 2,613,419 | 10/1952 | Dorgelys | 24/157 R |
| 2,614,306 | 10/1952 | Dzus | 24/221 R |
| 2,948,038 | 8/1960 | Benda | 24/157 R |

*Primary Examiner*—Bernard A. Gelak

*Attorney, Agent, or Firm*—Clarence A. O'Brien; Harvey B. Jacobson

[57] ABSTRACT

Apparatus for fastening spaced ends of a necklace and the like or for locking a safety pin of a badge, brooch, or the like, the invention comprises a rotatable locking member having spaced opposing bayonet slots formed in arcuate wall portions of the locking member. The wall portions are discontinuous about diametrically aligned portions of the periphery of the locking member to define aligned openings which receive a portion of a safety pin or spring thereinto, the locking member being rotatable to engage said portion of the safety pin or spring within the bayonet slot, thereby to releasably lock the pin or spring therewithin.

3 Claims, 21 Drawing Figures

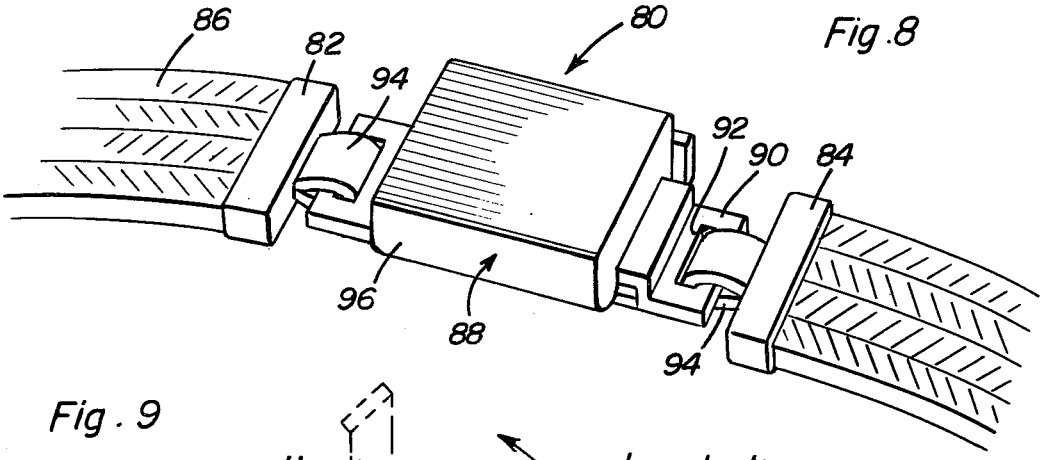
Fig. 8
Fig. 9
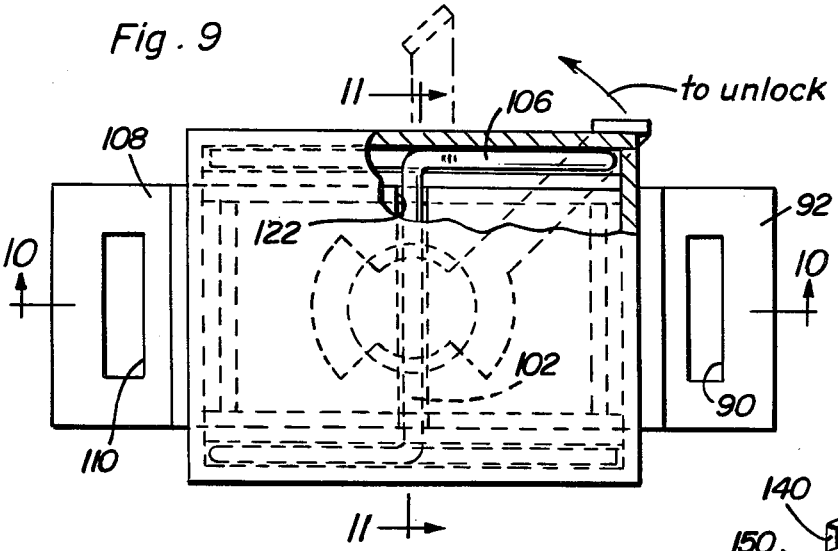
Fig. 12
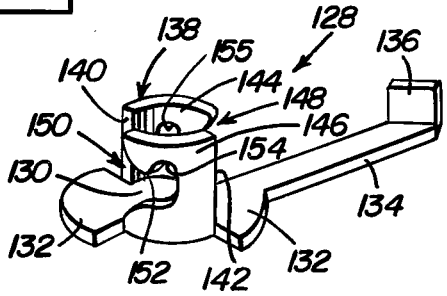
Fig. 10
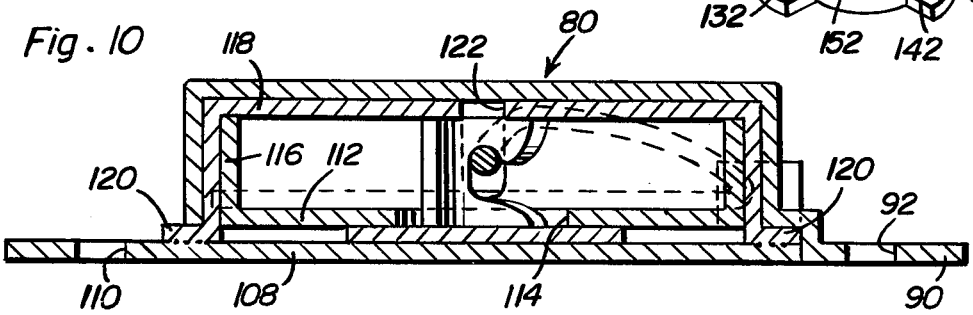
Fig. 11
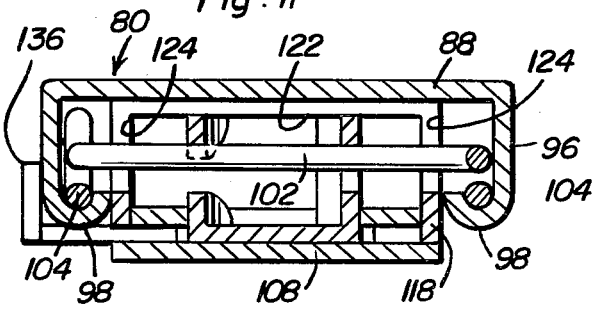
Fig. 13
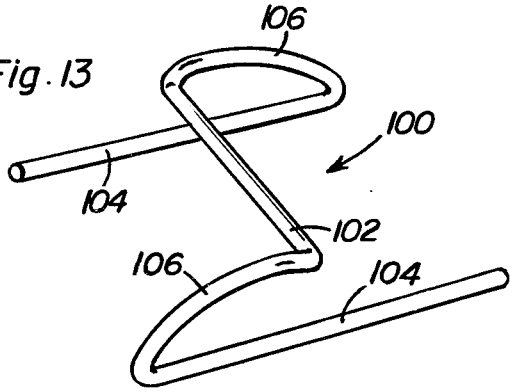

FASTENER

BACKGROUND OF THE INVENTION

1. Field of the Invention

The invention relates to apparatus for fastening decorative objects, such as brooches, necklaces, watchbands, and the like, to the person or apparel of a wearer.

2. Description of the Prior Art

History does not record the first instance of the use of decorative and symbolic articles, now commonly referred to as jewelry, which articles have for centuries taken the form of necklaces, bracelets, chains, and pins, badges, or brooches, and the like. In order to releasably fasten such articles to the person or apparel of a wearer, clasps and similar fasteners were devised, the origins of which are not now known. In more recent times, improvements have been made to such fastening apparatus, the provision of safety attachments for preventing accidental opening of the fastening apparatus and the resulting loss of the article of jewelry being a primary objective of many such improvements. As an example, the disclosure of U.S. Pat. No. 2,613,419 provides a teaching of an improved fastener having structure capable of preventing disengagement of a pin portion thereof from slots formed in a locking member carried on an article of jewelry. This improved fastener of the prior art comprises a locking member having a pair of bayonet slots formed therein, the slots particularly receiving the distal end portion of a safety pin thereinto on rotation of the locking member to lock the safety pin to the locking member. Fabric or other pierceable material forming an article of clothing or the like into which the safety pin can be inserted is thus held between a pivot mount on which one end of the safety pin is mounted and the locking member, the major body portion of the safety pin being held to the clothing fabric. This prior art fastener is further provided with a resilient spring member which acts to force the safety pin against inner surfaces of the bayonet slots, thereby to more securely maintain the safety pin in engagement with said bayonet slots. The present invention further improves the fastener art and particularly structures of the kind exemplified by the fasteners of the aforesaid patent. In particular, the several embodiments of the present fastening apparatus are provided with housing structures which enclose locking members similar to the locking member of the aforesaid patent, the locking members receiving a portion of a safety pin or spring within bayonet slots formed therein and being rotatable from externally of the housing structures to lock the safety pin or spring therewithin. The housing structures of the present invention provide additional security to the fastening apparatus and particularly act to prevent accidental fouling of projecting and receiving portions of the apparatus with fabric or other extraneous objects.

SUMMARY OF THE INVENTION

The invention provides fastening apparatus capable in the several embodiments thereof of securely fastening either a safety pin in engaging relation with an article of clothing piercingly receiving said pin or spaced ends of a bracelet, necklace, watchband, or the like, to prevent said spaced ends from being disconnected accidentally. The present apparatus can be easily fastened or unfastened with a minimum of effort and skill, the locking functions accomplished by the apparatus being unencumbered and not subject to accidental disruption by extraneous influences or internal stresses. In the most general sense, the invention provides fastening apparatus capable of locking a safety pin pivotally mounted at one end to the rear surface of a badge, brooch, or "pin", the free end of the safety pin being insertable through a portion of an article of clothing and then locked by a locking member to hold the portion of the article of clothing between the ends of the safety pin, the piece of jewelry to which the present fastening apparatus is attached being thereby mounted to the article of clothing. The locking member comprises an annular wall, the wall being discontinuous at diametrically opposite portions thereof to form oppositely spaced openings in said wall, the openings receiving portions of the free end of the safety pin thereinto. The two wall portions of the annular wall each have one bayonet slot formed therein, the bayonet slots being formed in diametrically opposite ends of the wall portions. The annular wall of the locking member is mounted on a base and is freely received within a housing, the housing having a slotlike recess formed in the upper and side portions thereof, the annular wall being rotatable within the housing to align the oppositely spaced openings therein with the slot-like recess formed in the housing. The free end of the safety pin can therefore be simultaneously received within the recess in the housing and within the openings in the annular wall. An extension of the base on which the annular wall is mounted extends externally of the housing to allow the locking member to be rotated within the housing, thereby to cause portions of the safety pin lying in the oppositely spaced openings in the annular wall to be received and locked within the bayonet slots on a one-quarter turn rotation of the locking member. A reverse one-quarter turn rotation of the locking member frees the safety pin for release from the confines of the housing and the locking member.

Further embodiments of the invention function similarly, a locking member such as described above being carried by one end of a bracelet, or the like, and mating with a straight portion of a spring or pin member carried within a housing, the housing being attached to the other end of the bracelet. The two ends of the bracelet are attached together by engaging the straight portion of the spring or pin member with bayonet slots formed in the locking member, rotation of the locking member within the fastening apparatus causing the two separable portions of said fastening apparatus (and thus the two ends of the bracelet) to be releasably locked together.

Accordingly, it is an object of the present invention to provide a fastening apparatus including a rotatable locking member disposable within a housing to receive the safety pin of an article of jewelry, such as a badge, brooch, or the like, within bayonet slots formed in said locking member, rotation of the locking member receiving portions of the safety pin within said bayonet slots to lock such safety pin in a fixed relation to the article of jewelry.

It is another object of the present invention to provide a fastening apparatus including a rotatable locking member carried within a first housing secured to one end of an article of jewelry, such as a bracelet, or the like, a spring having a straight portion being carried by a second housing attached to the other end of the article of jewelry, the straight portion of the spring being received within a slot-like recess in the first housing and being receivable within the housing within bayonet slots in the locking member on rotation of the locking member, thereby to secure the two ends of the article of jewelry together.

It is a further object of the invention to provide a rotatable locking member receivable within a housing, a spring being carried by the housing and having a straight portion thereof disposed internally of said housing, the locking member and the housing being attached to one end each of an article of jewelry such as a necklace, or the like, the straight portion of the spring being received within bayonet slots formed in the locking member on rotation of the locking member within the housing to secure the two ends of the article of jewelry together.

It is a still further object of the invention to provide fastening apparatus which is simple in construction and reliable in operation, the fastening apparatus being compact and attractive in appearance and being inexpensive to manufacture.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 8 is a perspective view of a second embodiment of the present invention shown connecting spaced ends of an article of jewelry, such as a watchband or other strap-like article;

FIG. 9 is a top plan view partially cut away of the second embodiment of the invention;

FIG. 10 is a sectional view taken along line 10—10 of FIG. 9;

FIG. 11 is a sectional view taken along line 11—11 of FIG. 9;

FIG. 12 is a perspective view of the locking member according to the second embodiment of the invention;

FIG. 13 is a perspective view of a spring portion of the second embodiment of the invention, a straight midportion of the spring being adapted to be engaged by the locking member for connection of separable portions of the structure;

DESCRIPTION OF THE PREFERRED EMBODIMENTS

Figure 1:
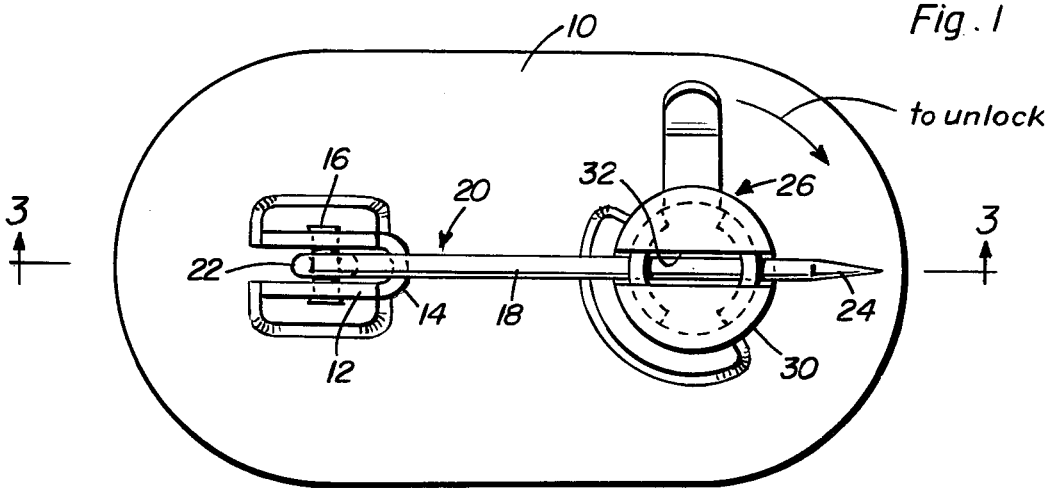
FIG. 1 is a top plan view of a first embodiment of the present invention, a safety pin held by the locking member of the invention being shown in a locked position.

Referring now to the drawings and particularly to FIGS. 1 through 7, a first embodiment of the invention is shown, said embodiment acting to fasten a base 10 to a desired substrate (not shown) in cooperation with a safety clasp pin 20 of known construction. The base 10 can take the form of a mounting plate onto which an article of jewelry, such as a badge or other decorative article, is disposed, the base 10 supporting the decorative article on an outer surface thereof and supporting the safety clasp pin 20 and a locking assembly 26 according to the invention on an inner surface. The safety clasp pin 20 is seen to be mounted for pivotal movement by means of a pivot pin 16 which is held between a pair of spaced parallel mounting projections 12, the projections 12 being formed integrally with or otherwise attached to the surface of the base 10. The safety clasp pin 20 is comprised of an arm 18 having an eye 22 formed at the inner end thereof, the eye 22 receiving the pivot pin 16 into the open portion thereof in a known manner in order that the safety clasp pin 20 is pivotally mounted to the base 10. The arm 18 is further provided with a sharpened point 24 at the free end thereof, the sharpened point 24 facilitating penetration of a fabric or similar material, such as forms an article of clothing, thereby to connect the base 10 to a desired substrate which typically takes the form of an exterior surface portion of an article of clothing. An arcuate support bar 14 preferably extends between and connects the mounting projections 12 and acts to limit the inward travel of the safety clasp pin 20 as particularly seen in FIGS. 2 and 3.

The safety clasp pin 20 is particularly seen in FIGS. 1, 2, 3 and 4 to be fastened in a clasping position by means of the locking assembly 26, portions of a fabric or other material penetrated by the safety clasp pin 20 being held between the mounting projections 12 and the locking assembly 26 and carried on median portions of the arm 18 in a known manner. The locking assembly 26 acts to receive distal end portions of the safety clasp pin 20 and to lock said pin 20 in a secure, clasping position relative to the base 10. The locking assembly 26 is seen to comprise a locking member 28, which locking member 28 can be most clearly seen in FIG. 5. The locking member 28 is received within a lock housing 30, the lock housing 30 comprising a hollow cylindrical structure open at its lower end and closed at its upper end except for the provision of a slot 32 formed diametrically across the closed end thereof. The slot 32 can be best seen in FIGS. 1 and 6 to have the longitudinal axis thereof parallel to and aligned with the longitudinal axis of the arm 18 of the safety clasp pin 20, distal end portions of the arm 18 being received within the slot 32 as will be described hereinafter. The slot 32 in the lock housing 30 is further provided with lateral slot portions 34 which extend from the ends of the slot 32 into side walls of the lock housing 30, the lateral slot portions 34 allowing distal end portions of the safety clasp pin 20 to be received internally of the lock housing 30 as particularly seen in FIGS. 2 through 4. The lock housing 30 is formed integrally with or is otherwise attached to the base 10, such as by attaching said lock housing 30 to an arcuate spacer 38 which is mounted to the base 10. Mounting of the lock housing 30 to the spacer acts to elevate lower edge portions of the lock housing 30 above said base 10, thereby to form an opening 36 which extends along a peripheral portion of the lock housing 30. The opening 36 extends at least along a 90 degree arc to provide for movement of a structural element extending through said opening 36 as will be described hereinafter. As particularly seen in FIG. 1, the arcuate spacer 38 is disposed about the side of the locking assembly 26 nearmost to the mounting projections 12, the spacer 38 extending substantially to one lateral side only of said locking assembly 26.

Figure 5:
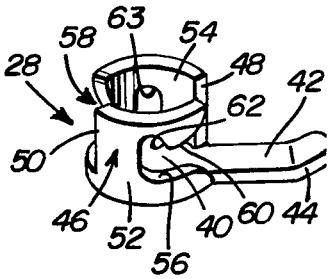
FIG. 5 is a perspective view of the rotatable locking member according to the first embodiment of the invention.

Prior to attachment of the lock housing 30 to the arcuate spacer 38, the major body portions of the locking member 28 are inserted into the interior of said lock housing, the locking member 28 thus being enclosed within the lock housing 30 and permanently therewithin on attachment of said lock housing 30 to the arcuate spacer 38. Referring particularly to FIG. 5, the locking member 28 is seen to comprise a base plate 40 formed in a circular conformation and having an actuation arm 42 extending radially from a peripheral edge portion thereof. The actuation arm 42 is seen to have a projection 44 formed at the distal end thereof in order to facilitate grasping of said actuation arm 42, the projection 44 being slightly bent to facilitate use thereof. The base plate 40 is seen to have a circular wall 46 extending from perimetric edge portions thereof, the circular wall 46 being discontinuous along a diameter of the base plate 40 which aligns with the longitudinal axis of the actuation arm 42. Accordingly, diametrically opposing openings 48 and 50 separate arcuate wall portions 52 and 54 of the circular wall 46, the openings 48 and 50 substantially aligning with a diameter of the base plate 40 which extends along the actuation arm 42 to coincide with the longitudinal axis of said arm 42. The openings 48 and 50 respectively communicate with shaped recesses or "bayonet slots" 56 and 58 formed respectively in the arcuate wall portions 52 and 54. The bayonet slots 56 and 58 are defined at outer portions thereof by arcuate cam surfaces 60 which border outwardly extending free edge portions of the wall portions 52 and 54, respectively. The bayonet slots 56 and 58 respectively terminate at inward portions thereof in locking recesses 62 and 63, said locking recesses 62 and 63 extending substantially outwardly of the base plate 40 toward the free peripheral edge portions of the arcuate wall portions 52 and 54. The locking recesses 62 and 63 receive portions of the arm 18 of the safety clasp pin 20 as will be described hereinafter for locking of said pin 20 within the locking assembly 26.

Figure 2:
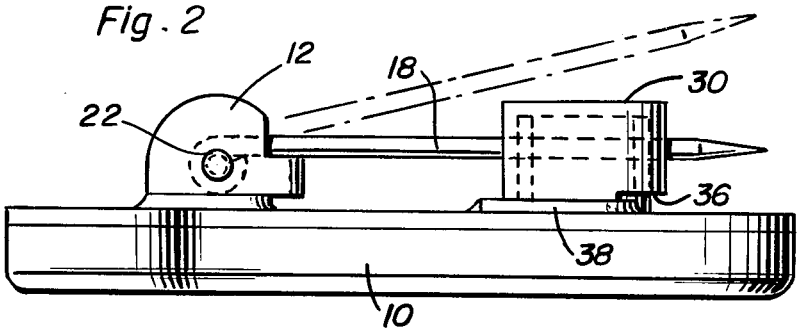
FIG. 2 is a side elevational view of the structure of FIG. 1.
Figure 3:
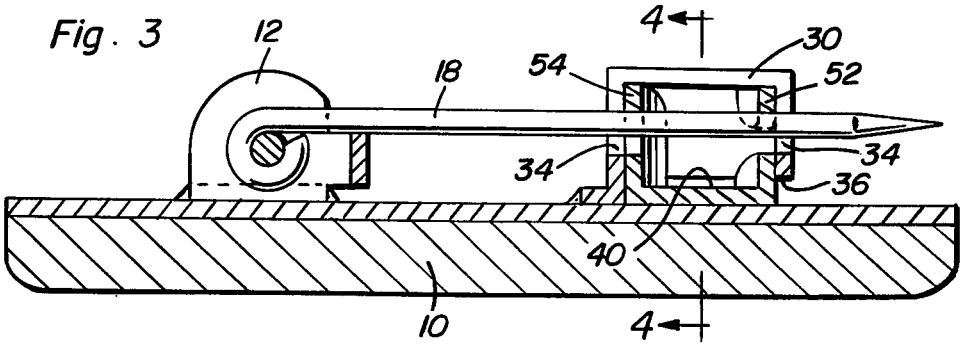
FIG. 3 is a side elevational view in section taken along line 3—3 of FIG. 1.
Figure 4:
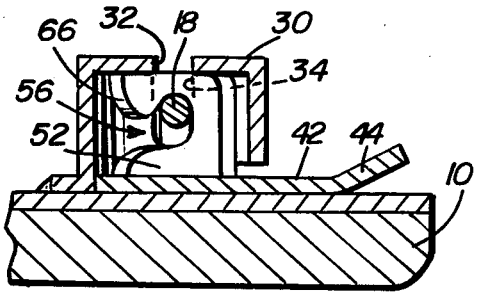
FIG. 4 is a sectional view taken along line 4—4 of FIG. 3.
Figure 6:
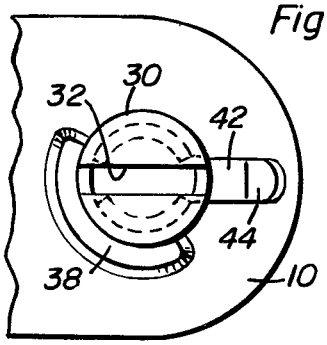
FIG. 6 is a top plan view of a portion of the structure of FIG. 1, the locking member according to the first embodiment of the invention being shown in the unlocked position.

In operation, the actuation arm 42 which extends through the opening 36 outwardly of the lock housing 30 allows rotation of the locking member 28 at least through an arc of approximately 90 degrees. As seen in FIG. 6, alignment of the longitudinal axis of the actuation arm 42 with the longitudinal axis of the slot 32 formed in the upper surface of the lock housing 30 brings the diametrically opposing openings 48 and 50 in the circular wall 46 of said locking member 28 into communicative alignment with said slot 32 and the lateral slot portions 34 formed in the side walls of the lock housing 30. In this position, the safety clasp pin 20 can be moved downwardly as seen in FIGS. 2 and 3, such that a distal end portion of the pin 20 is received within the slot 32 and also into the openings 48 and 50. Rotation of the locking member 28 through a substantially 90 degree arc causes portions of the pin 20 to be received respectively within the bayonet slots 56 and 58 formed in the opposing arcuate wall portions 52 and 54. The portions of the pin 20 are caused to follow the arcuate cam surfaces 60 and are caused to be subjected to successively higher tension levels during movement along said cam surfaces 60 until said portions of said pin 20 are released from the cam surfaces 60 and snap outwardly of the base plate 40 into the locking recesses 62 and 63. The safety clasp pin 20 is thereby locked within the locking assembly 26, such as is particularly shown in FIGS. 1 and 4, reduced-in-diameter portions of the arcuate wall portions 52 and 54, which overlie the locking recesses 62 and 63, preventing the pin 20 from exiting the lock housing 30 through the slot 32.

Referring particularly to FIG. 1, a safety clasp pin 20 is seen to be locked within the locking assembly 26, clockwise rotation of the actuation arm 42 being necessary in order to disengage the safety clasp pin 20 from the locking recesses 62 and 63 and subsequently from the bayonet slots 56 and 58. On movement of the actuation arm from the position seen in FIG. 1 to the position seen in FIG. 6, that is, a substantially 90 degree or one-quarter turn in a clockwise direction as seen in the figrues, the locking member 28 releases the safety clasp pin 20 to allow movement of said pin 20 from the lock housing 30 through the slot 32 formed in upper portions thereof. Therefore, the safety clasp pin 20 can thereby be locked and unlocked in order to securely and releasably fasten the base 10 to a desired substrate.

Figure 7:
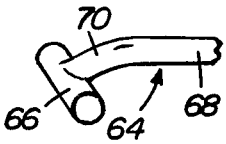
FIG. 7 is a detailed perspective view of a portion of an alternate confirmation of the pivotal end of the safety pin.

Referring now to FIG. 7, an alternative embodiment of a safety clasp pin is seen at 64, the pin 64 comprising an arm 68 which terminates in an integral pivot pin 66, the pivot pin 66 being intended to be mounted between structure such as the mounting projections 12 previously described. The arm 68 of the safety clasp pin 64 is further formed with an angled portion 70 disposed between the pivot pin 66 and the remaining portions of the arm 68, the angled portion 70 facilitating the cooperative relation of the pin 64 with a locking assembly, such as the locking assembly 26 described previously. It should also be understood that the opening 36 between the lock housing 30 and the surface of the base 10 could be otherwise formed, such as by extending lower peripheral edge portions of the housing 30 at those locations which would normally contact the spacer 38. In such a structure, a separate spacer would not be necessary since the extended peripheral edge portions of the housing 30 would provide the essential function of the spacer 38.

Referring now to FIGS. 8 through 14, a fastener assembly 80 according to a second embodiment of the invention is seen to connect spaced ends 82 and 84 of a watchband or similar articles 86. The fastener assembly 80 is seen to comprise an assembly housing 88 of box-like construction, the housing 88 being formed in the shape of a regular parallelepiped and having a lower major surface thereof open to receive a spring 100 into the interior thereof. A minor side wall of the assembly housing 90 is provided with an integral link plate 90 having a slot 92 formed therein. A loop 94 extending from the spaced ends 82 of the watchband 86 is received within the slot 92 for attaching the assembly housing 88 to said spaced end 82. The assembly housing 88 can be releasably connected to remaining portions of the fasteners assembly 80 as will be described hereinafter, the remaining portions of the fastener assembly comprising a base plate 108 having a slot 110 formed in one end thereof, a loop 94 extending from the spaced end 84 of the watchband 86 being received within the slot 110 formed in said base plate 108. The spaced ends 82 and 84 of the watchband 86 are thereby held together by separable portions of the fastener assembly 80, one such separable portion comprising the assembly housing 88 and the spring 100 mounted therewithin and the other such portion comprising the base plate 108 onto which is mounted other structural elements as will be described hereinafter.

The assembly housing 88 is seen to have lateral side walls 96, the planes of which side walls 96 extend substantially parallel to the nominal longitudinal axis of the watchband 86. Arcuate side wall flanges 98 extend inwardly of the side walls 96 along lateral edges of said side walls, which lateral edges partially define the open face of said assembly housing 88.

The spring 100 is received within the interior of the assembly housing 88, the spring 100 comprising a straight midportion 102 and straight leg portions 104 disposed perpendicular to said midportion 102 at opposite ends thereof. The straight leg portions 104 are joined to the straight midportion 102 of the spring 100 by arcuate portions 106, the straight leg portions 104 being received one each within the arcuate side wall flanges 98 of the assembly housing 88. The spring 100 is thereby held within the interior of the assembly housing 88. Although the spring 100 functions primarily to provide a structural element onto which a locking member to be described hereinafter can be secured, the structure of the spring 100 provides a resistance to deformation valuable to the functioning of the fastener assembly 80. In effect, even though the spring 100 may be deformed out of a normal position, the resiliency of the spring causes such spring to return to a normal position on release of any deforming pressure. Since the spring 100 is held under a slight compressive tension within the interior of the housing 88, the straight midportion 102 of such spring 100 is maintained in a position necessary to mate with structural to be described hereinafter, the resilient nature of the spring 100 returning the straight midportion 102 to this desired position in the event the spring 100 is temporarily deformed. As a particular feature of the invention, the resiliency of the spring 100 allows structure to be described hereinafter to be able to temporarily deform the straight midportion 102 of the spring 100 downwardly in order to lockingly fit said midportion 102 in a locking position within the fastener assembly 80. The assembly housing 88 is seen in FIG. 11 to be spaced outwardly from the upper surface of the base plate 108, such that portions of the actuation elements of the structure can extend outwardly of the structure in order that such structure can be grasped and actuated as will be described hereinafter.

Figure 14:
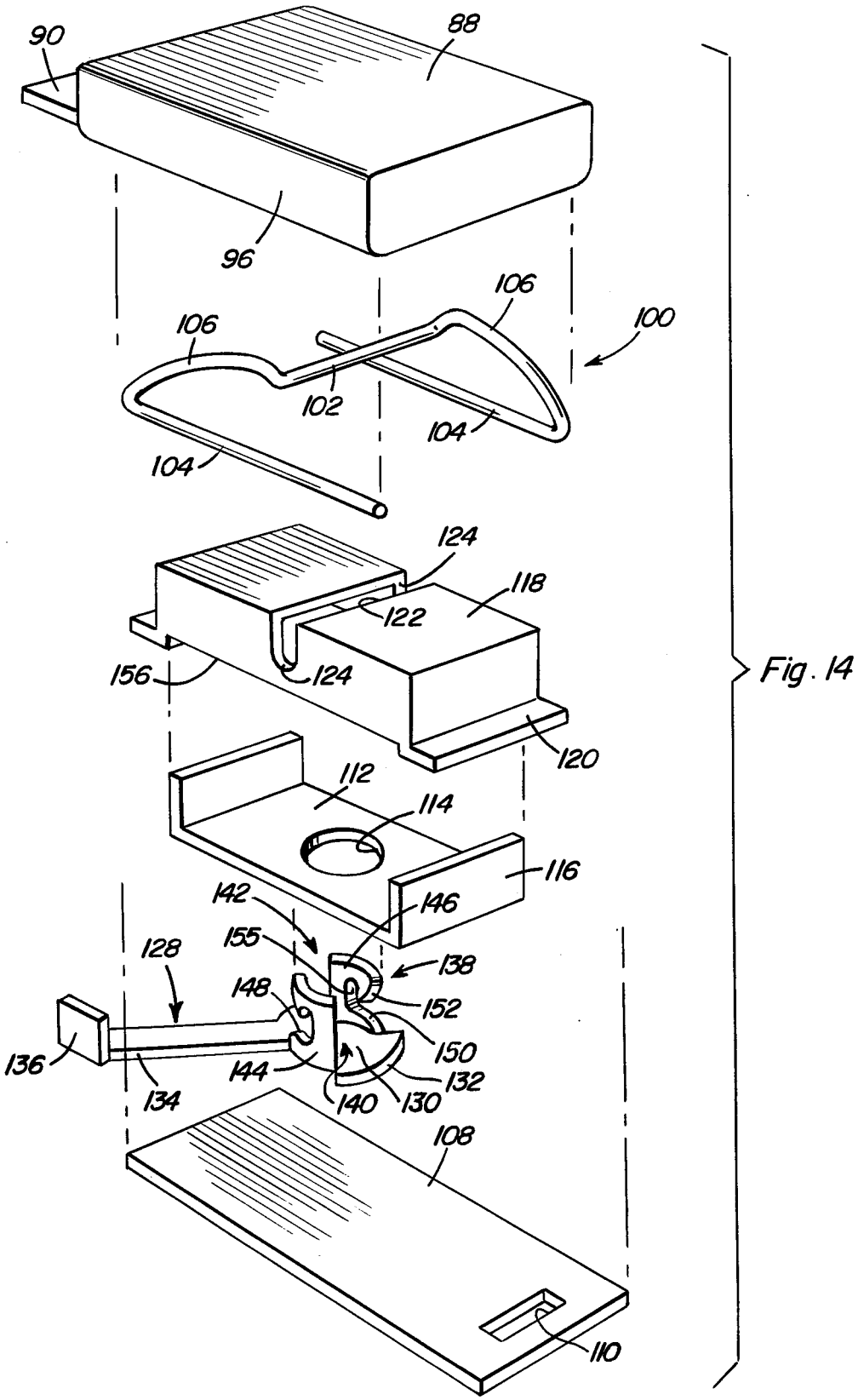
FIG. 14 is an assembly view in perspective of the several elements of the structure according to the second embodiment of the invention.
Figure 15:
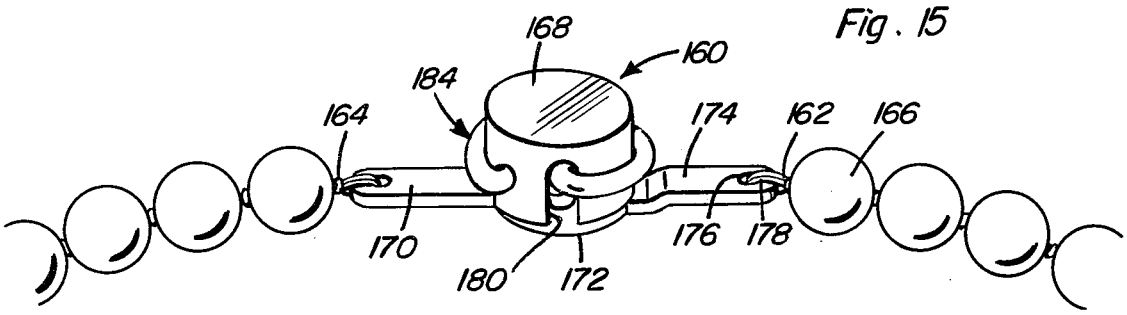
FIG. 15 is a perspective view of a third embodiment of the present invention shown connecting the spaced ends of a necklace.

As particularly seen in FIGS. 10, 11 and 14, the base plate 108 is seen to have a lock housing 118 secured to an upper surface thereof, the lock housing 118 being box-like in confirmation and having side flanges 120 extending from opposite sides thereof, the flanges 120 being secured to the base plate 108 such as by welding or the like. A spacer plate 112 and a locking member 128 are fitted within the lock housing 118 prior to attachment of said lock housing to the base plate 108, the arrangement of the spacer plate 112 and locking member 128 within said lock housing 118 being described hereinafter. The spacer plate 112 is seen to be provided with an aperture 114 located centrally therein and sized to receive portions of the locking member 128 therethrough. The spacer plate 112 is further provided with upwardly extending alignment walls 116 which act to limit the upward travel of said spacer plate 112 within the lock housing 118. Therefore, the spacer plate 112 is disposed in spaced relation to the base plate 108 when the structure is assembled, the plate 112 and the walls 116 acting to provide a spacing between the base plate 108 and the underside of the plate 112 which is of a dimension sufficient to allow movement of portions of the locking member 128 therewithin but not allow excessive movement of said locking member.

The lock housing 118, being box-like in conformation, as aforesaid, has a closed upper major face and an open major lower face oppositely spaced therefrom. The upper face of the lock housing 118 is provided with a slot 122 extending thereacross, the slot 122 communicating with lateral slot portions 124 formed in spaced side walls of said lock housing 118. The slot 122 and the lateral slot portions 124 correspond in nature and function to the slot 32 and the lateral slot portions 34 of the lock housing 30 of the embodiment of FIGS. 1 through 6. The locking member 128 is also seen to have a construction similar to the locking member 28 of the embodiment of FIGS. 1 through 6. In particular, the locking member 128 is comprised of a base plate 130 having arcuate chord portions 132 extending from diametrically opposed peripheral edges thereof. As particularly seen in FIGS. 9, 12 and 14, an actuation arm 134 extends from one of the arcuate chord portions 132 along a lateral edge thereof, the actuation arm 134 terminating in a grip member 136 to facilitate rotation of the locking member 128. A circular wall 138 extends from the base plate 130 of the locking member 128, the circular wall 138 being discontinuous along a diameter which bisects the arcuate chord portions 132, the discontinuations in the circular wall 138 defining diametrically opposed openings 140 and 142. The openings 140 and 142 are proximal to and aligned with the arcuate chord portions 132. Arcuate wall portions 144 and 146 are formed by the openings in the circular wall 138, said wall portions 144 and 146 respectively having bayonet slots 148 and 150 formed therein, the bayonet slots 148 and 150 having the outer open ends thereof communicating with respective openings 142 and 140. Arcuate cam surfaces 152 formed on the wall portions 144 and 146 function in a manner identical to the arcuate cam surfaces 60 of the embodiment of FIGS. 1 through 6. The arcuate cam surfaces 152 similarly extend to locking recesses 154 and 155 formed in the arcuate wall portions 144 and 146.

On assembly of the lock housing 118 to the base plate 108, the spacer plate 112 is inserted within the interior of the lock housing 118. The arcuate wall portions 144 and 146 of the locking member 128 are inserted into the aperture 114 in a spacer plate 112 through the underside thereof, the resulting assembly then being attached to the base plate 108 as aforesaid. A separable portion of the fastener assembly 80 is thereby formed, the separable portion comprising the base plate 108, the locking member 128, the spacer plate 112, and the lock housing 118. The lock housing 118, in cooperation with the base plate 108, is seen to enclose the spacer plate 112 and portions of the locking member 128. An elongated slot 156 formed in a lateral side wall of the lock housing 118 adjacent to the side walls bearing the side flanges 120 receives the actuation arm 134 therethrough, the actuation arm being movable within the elongated slot 156 to rotate the locking member 128 within the aperture 114 in the spacer plate 112. The arcuate chord portions 132 of the locking member 128 are received within the spacing between the base plate 108 and the spacer plate 112, said chord portions 132 acting to stabilize the locking member 128 within the assembly. The actuation arm 134 is provided at least a freedom of movement equivalent to a 90 degree arc so that the locking member 128 can be rotated within the assembly at least a one-quarter turn.

Referring now particularly to FIGS. 9, 10, 11 and 14, the assembly housed by the lock housing 118 and the base plate 108 is seen to be fitted into the open face of the assembly housing 88, the straight midportion 102 of the spring 100 being received within the slot 122 and the lateral slot portions 124 formed in the lock housing 118. When the locking member 128 is disposed within the lock housing 118 in the position shown in phantom in FIG. 9, the openings 140 of the locking member 128 are disposed to communicate with the slot 122 in the lock housing 118, the straight midportion 102 of the spring 100 being thereby also received within said openings 140. Accordingly, on rotation of the actuation arm 134 in a clockwise direction as seen in FIG. 9, the straight midportion 102 of the spring 100 is caused to enter the bayonet slots 148 and 150 and to follow the arcuate cam surfaces 152 in a manner similar to that described for equivalent structure disclosed relative to FIGS. 1 through 6 hereinabove. The straight midportion 102 of the spring 100 is caused to be received therefore into the locking recesses 154, the separable portions of the fastener assembly 80 being thereby locked together, the assembly housing 88 substantially enclosing and housing the fastener assembly 80. The fastener assembly 80 is readily unlocked by movement of the actuation arm 134 in a counterclockwise direction as seen in FIG. 9 to align the openings 140 in the locking member 128 with the slot 122 in the lock housing 118, the assembly housing 88 being thereby removable from interlocking relation with the lock housing 118 and the locking member 128.

Referring now to FIGS. 15 through 21, a fastener assembly 160 according to a third embodiment of the invention is seen to releasably connect spaced ends 162 and 164 of a necklace or similar article 166. The fastener assembly 160 comprises a lock housing 168 of substantially cylindrical conformation having a like plate 170 extending from a lower perimetric edge portion thereof, the lock housing 168 being closed at its upper end and open at its lower end. Received within the interior of the lock housing 168 when in the fastening configuration is a locking member 172 which is similar in structure and operation to the locking members 28 and 128 described hereinabove. The locking member 172 has an elongated actuation arm 174 extending from a lower perimetric edge portion thereof, the actuation arm 174 being similar in conformation to the link plate 170 on the lock housing 168. Both the link plate 170 and the actuation arm 174 have an aperture 176 formed in the distal ends thereof, the apertures 176 each receiving loops 178 therethrough, one of the loops 178 being attached to the spaced end 162 of the necklace 166 and the other of the loops 178 being attached to the spaced end 164 of the necklace 166. Therefore, when the locking member 172 is received and locked within the lock housing 168, the spaced ends 162 and 164 of the necklace 166 are securely connected to each other through the fastener assembly 160 to maintain the necklace 166 around the neck of a wearer.

Figure 16:
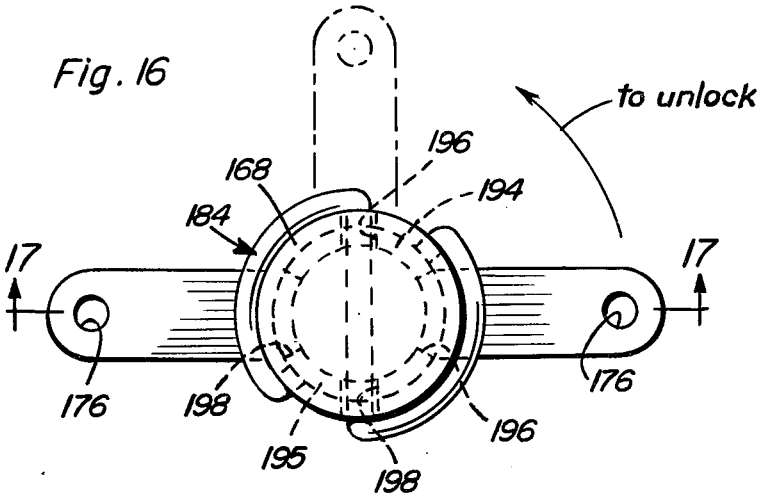
FIG. 16 is a top plan view of the third embodiment of the invention.

The lock housing 168 is provided with elongated slots 180 and 181 disposed in diametrically opposing positions in the side walls of the lock housing 168, the longitudinal axes of the slots 180 and 181 being disposed perpendicular to the longitudinal axis of the link plate 170, the planar diameter of the lock housing 168 along which the slots 180 and 181 are essentially aligned being also perpendicular to the longitudinal axis of the link plate 170. Apertures 182 and 183 are also formed in the side walls of the lock housing 168 medially of its height, the slots 180 and 181 being displaced substantially 45 degrees in a clockwise sense as seen in FIG. 16 from the slots 180 and 181 respectively. The apertures 182 and 183 preferably extend through the side walls of the lock housing 168 to communicate with the interior thereof.

Figure 18:
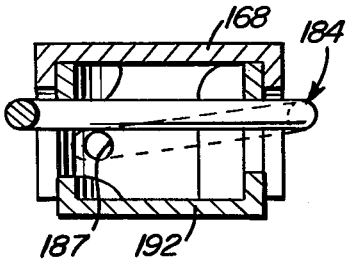
FIG. 18 is a sectional view taken along line 18—18 of FIG. 17.
Figure 20:
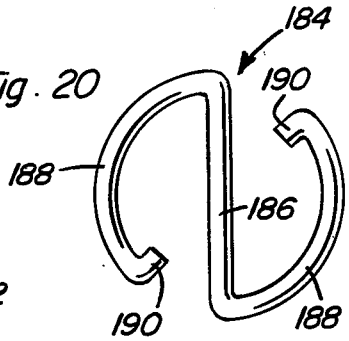
FIG. 20 is a top plan view of a spring which is carried by the housing portion of the third embodiment of the invention; and, FIG. 21 is a side elevational view of the locking member of the third embodiment of the invention.
Figure 17:
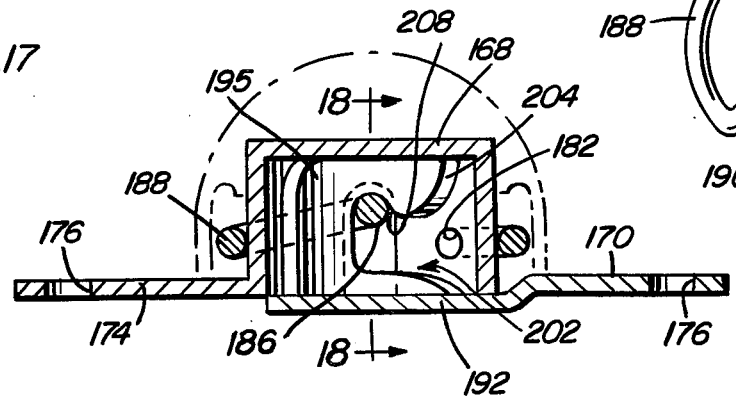
FIG. 17 is a sectional view taken along line 17—17 of FIG. 16.
Figure 19:
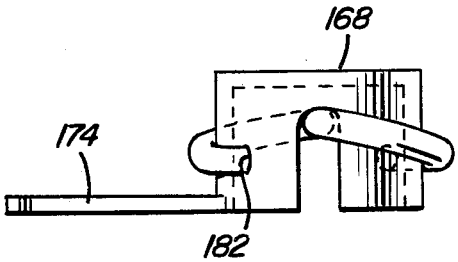
FIG. 19 is a side elevational view of a housing portion of the third embodiment of the invention.
Figure 21:
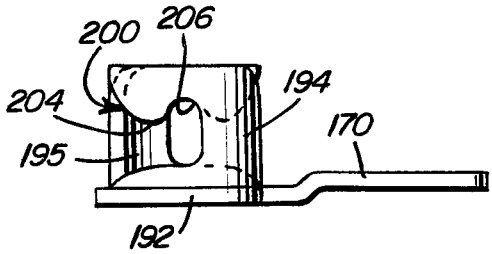

A spring 184, particularly seen in FIG. 20, is comprised of a straight midportion 186 and arcuate lateral portions 188 which extend one each from opposite ends of the straight midportion 186, the arcuate lateral portions 188 also extending downwardly and out of the horizontal plane in which the straight midportion 186 lies as best seen in FIGS. 16 and 19. Each of the arcuate lateral portions 188 has an integral terminal locking tab 190 which extends inwardly of the spring 184 from the free ends of each said arcuate lateral portion 188. As seen in FIGS. 15 through 19, the spring 184 is mounted to the lock housing 168, the straight midportion 186 being inserted into the interior of said lock housing 168, end portions of the straight midportion 186 being received within the slots 180 and 181 while the arcuate lateral portions 188 substantially circumscribe the lock housing 168 about the outer periphery thereof. The straight midportion 186 of the spring 184 is positioned as seen in FIGS. 17 and 19 to the full upward extent of the slots 180 and 181, the slots 180 and 181 extending into the side walls of the lock housing 168 approximately 70% of the height thereof. When the straight midportion 186 of the spring 184 is thus positioned within the slots 180 and 181, the terminal locking tabs 190 on the ends of the arcuate lateral portions 188 oppose and are disposed contiguously to the outwardly opening portions of the apertures 176 formed in the side walls of the lock housing 168. The tabs 190 are readily fitted one each into the apertures 176, the spring 184 having an inward resiliency which assists in retaining the tabs 190 within the apertures 176. The spring 184 is thus mounted and held on the lock housing 168, the straight midportion 186 being disposed within the interior of the lock housing 168 and being effectively suspended therewithin along a planar diameter of said lock housing 168 which extends centrally through the slots 180.

The locking member 172 is similar in structure and operation to the locking members 28 and 128 described hereinabove, the locking member 172 comprising a substantially circular base plate 192 having spaced arcuate wall portions 194 and 195 extending from upper peripheral edge portions of said base plate 192. Diametrically opposed openings 196 and 198 separate the wall portions 194 and 195, the openings 196 and 198 being aligned along a diameter of the base plate 192 which, when extended, has an extended portion which is coincidental with the longitudinal axis of the actuation arm 174. The wall portions 194 and 195 have bayonet slots 200 and 202 formed therein, the slots 200 and 202 respectively opening into openings 196 and 198 in a fashion identical to that described relative to the first and second embodiments of the invention as described hereinabove. Upper wall surfaces of the bayonet slots 200 and 202 are formed near the openings 196 and 198 into arcuate cam surfaces 204 which extend inwardly of the slots 202 and 204 to locking recesses 206 and 208 disposed at the inner terminii of the slots 200 and 202.

In operation, the wall portions 194 and 195 of the locking member 172 are inserted into the interior of the lock housing 168 through the lower opened end thereof, the locking member 172 being oriented relative to the lock housing 168 as shown in phantom in FIG. 16, that is, with the actuation are 174 disposed perpendicular to the locking member 172. In this disposition, the openings 196 and 198 between the wall portions 194 and 195 are oriented to receive end portions of the straight midportion 186 of the spring 184 thereinto, the locking member 172 being thereby capable of substantially full receipt into the interior of the lock housing 168 as seen in FIG. 18. On rotation of the locking member 172 through a substantially 90 degree arc, that is, as seen in FIG. 16, a displacement of the actuation arm 174 through a clockwise displacement of one-quarter turn, the straight midportion 186 of the spring 184 is received within the bayonet slots 200 and 202 at the ends of said straight midportion 186. The portions of the straight midportion 186 entering the slots 200 and 202 follow the arcuate cam surfaces 204 and are first biased downwardly during the 90 degree rotation of the locking member 172, the straight midportion 186 then snapping upwardly toward the completion of the 90 degree rotation to be received within the locking recesses 206 and 208. In the position shown in FIGS. 15 through 17, the straight midportion 186 of the spring 184 is positively held within the locking recesses 206 and 208 of the wall portions 194 and 195, the locking member 172 being thereby securely connected to and substantially within the interior of the lock housing 168. Counterclockwise movement of the actuation arm 174 through a 90 degree arc as seen in phantom in FIG. 16 releases the spring 184 from the locking recesses 206 and 208 and again aligns the openings 196 and 198 between the wall portions 194 and 195 with the straight midportion 186 and the spring 184. Therefore, the spring 184 (and the lock housing 168 to which said spring 184 is mounted) can be easily disengaged from the locking member 172 by relative vertical displacement of said lock housing 168 and locking member 172.

The three embodiments of the invention are therefore seen to provide fastening structures having locking members which fit into the interior of a lock housing, the lock housings each mounting or receiving a substantially straight portion of a spring or wire-like member through the interior thereof. The locking members of the several embodiments of the invention receive the straight spring portions disposed in the interior of the housing within spaced slots formed in said locking members and lock, on rotation of said locking members, the straight spring portions within locking recesses formed at the inner terminii of said slots, thereby to securely but releasably lock the lock housings to the locking members.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A detachable fastener, comprising:

a lock housing having at least one slot formed therein;

a fastener housing having an open inner end portion;

a locking bar mounted within the fastener housing and having at least a portion thereof for disposition within the lock housing through the slot in said lock housing;

a locking member rotatably received within the lock housing, said locking member including a pair of spaced walls each having edge portions, a first bayonet slot being disposed in one edge portion of one spaced wall and a second bayonet slot being disposed in the opposite edge portion of the other spaced wall, the slot in one wall opening in the opposite direction from the slot in the other wall, at least one bayonet slot being capable of receiving a portion of the locking bar when said locking bar is disposed within the lock housing through the slot in said lock housing to lock the locking bar to the locking member;

a base plate member, the lock housing being mounted to the base plate member;

first means on one end of the base plate member for connecting one end of an elongated article to the base plate member; and, second means on one end of the fastener housing for connecting the other end of the elongated article to the fastener housing, the lock housing being received within the open inner end portion of the fastener housing for receipt of said portion of the locking bar within the slot in the lock housing for engagement within at least one of the bayonet slots in the locking member to fasten the fastener housing to the lock housing and thus to the base plate member to detachably fasten the spaced ends of the elongated article together in spaced relation to each other.

2. The fastener of claim 1 and further wherein said locking member includes a substantially radially extending actuation arm, said actuation arm terminating in a grip member, said grip member being disposed in an accessible position outside of said fastener housing when said lock housing is received within the open inner end portion of said fastener housing, said actuation arm and grip member being operative to cause rotation of said locking member.

3. The fastener of claim 2 and further including a spacer plate accepted within said lock housing, said spacer plate including an aperture through which said spaced walls of said locking member are disposed for holding said locking member in a predetermined position in said lock housing.

* * * * *